US009324555B2

(12) United States Patent
Ptaschek et al.

(10) Patent No.: US 9,324,555 B2
(45) Date of Patent: Apr. 26, 2016

(54) AMALGAM SPHERES FOR ENERGY-SAVING LAMPS AND THEIR PRODUCTION

(71) Applicant: Umicore AG & Co. KG, Hanau-Wolfgang (DE)

(72) Inventors: Georg Ptaschek, Melbach (DE); Calogero Di Vincenzo, Hanau (DE)

(73) Assignee: UMICORE AG & CO. KG, Hanau-Wolfgang (DE)

( * ) Notice: Subject to any disclaimer, the term of this patent is extended or adjusted under 35 U.S.C. 154(b) by 0 days.

(21) Appl. No.: 13/929,096

(22) Filed: Jun. 27, 2013

(65) Prior Publication Data

US 2014/0009059 A1 Jan. 9, 2014

Related U.S. Application Data

(63) Continuation of application No. 12/595,762, filed as application No. PCT/EP2008/054839 on Apr. 22, 2008, now Pat. No. 8,497,622.

(30) Foreign Application Priority Data

Apr. 28, 2007 (EP) ..... 07008717

(51) Int. Cl.

| | |
|---|---|
| ***H01J 29/82*** | (2006.01) |
| ***H01J 63/04*** | (2006.01) |
| ***H01J 61/20*** | (2006.01) |
| ***C22C 7/00*** | (2006.01) |
| ***C22C 13/00*** | (2006.01) |
| ***H01J 61/28*** | (2006.01) |
| ***H01J 61/24*** | (2006.01) |

(52) U.S. Cl.

CPC . *H01J 61/20* (2013.01); *C22C 7/00* (2013.01); *C22C 13/00* (2013.01); *H01J 61/24* (2013.01); *H01J 61/28* (2013.01); *Y10T 428/2982* (2015.01)

(58) Field of Classification Search

CPC ..... H01J 61/24; H01J 61/20; H01J 61/28
See application file for complete search history.

(56) References Cited

U.S. PATENT DOCUMENTS

| | | | | |
|---|---|---|---|---|
| 4,015,162 | A | 3/1977 | Evans et al. | |
| 4,071,288 | A | 1/1978 | Evans et al. | |
| 4,145,634 | A | 3/1979 | Evans et al. | 313/490 |
| 4,216,178 | A | 8/1980 | Anderson | |
| 4,859,412 | A | 8/1989 | Groll et al. | |
| 5,520,560 | A | 5/1996 | Schiabel et al. | 445/9 |
| 5,828,169 | A * | 10/1998 | Myojo et al. | 313/490 |
| 5,882,237 | A | 3/1999 | Sarver et al. | |
| 6,312,499 | B1 * | 11/2001 | Rehmat et al. | 75/388 |
| 6,339,287 | B1 | 1/2002 | Sarver et al. | |
| 6,791,254 | B2 | 9/2004 | Stafford et al. | |
| 7,297,178 | B2 | 11/2007 | Kempf et al. | |
| 7,538,479 | B2 | 5/2009 | Yagi et al. | |
| 8,497,622 | B2 | 7/2013 | Ptaschek et al. | |
| 2003/0151351 | A1 * | 8/2003 | Stafford et al. | 313/490 |
| 2005/0265018 | A1 | 12/2005 | Yasuda | |
| 2006/0006784 | A1 | 1/2006 | Takahara | |
| 2007/0188073 | A1 | 8/2007 | Yagi et al. | 313/490 |
| 2007/0235686 | A1 | 10/2007 | Coda et al. | 252/181.6 |
| 2008/0001519 | A1 | 1/2008 | Hansen | |
| 2011/0250455 | A1 | 10/2011 | Gordon et al. | |
| 2014/0009059 | A1 | 1/2014 | Ptaschek et al. | |
| 2014/0055026 | A1 | 2/2014 | Hutin et al. | |

FOREIGN PATENT DOCUMENTS

| | | | |
|---|---|---|---|
| EP | 0033628 | A2 | 8/1981 |
| EP | 0 136 866 | A2 | 4/1985 |
| EP | 1 381 485 | A2 | 1/2004 |
| EP | 1381485 | B1 | 1/2004 |
| EP | 1268353 | B1 | 1/2007 |
| EP | 2 145 028 | A1 | 1/2010 |
| EP | 2 145 028 | B1 | 7/2010 |
| JP | 2000 251836 | A | 9/2000 |
| JP | 2000251836 | A | 9/2000 |
| WO | 94/18692 | A1 | 8/1994 |
| WO | 02/087810 | A2 | 11/2002 |
| WO | 2008/132089 | A1 | 11/2008 |

OTHER PUBLICATIONS

Attached is an abstract from Derwent for JP 62281249 A.
Machine translation of JP Publication 61186408A to Yorifuji et al.

* cited by examiner

*Primary Examiner* — Elmito Breval
*Assistant Examiner* — Zachary J Snyder
(74) *Attorney, Agent, or Firm* — Smith, Gambrell & Russell, LLP

(57) ABSTRACT

Energy-saving lamps contain a gas filling of mercury vapor and argon in a gas discharge bulb. Amalgam spheres are used for filling the gas discharge bulb with mercury. A tin amalgam having a high proportion by weight of mercury in the range from 30 to 70% by weight is proposed. Owing to the high mercury content, the amalgam spheres have liquid amalgam phases on the surface. Coating of the spheres with a tin or tin alloy powder converts the liquid amalgam phases on the surface into a solid amalgam having a high tin content. This prevents conglutination of the amalgam spheres during storage and processing.

24 Claims, No Drawings

AMALGAM SPHERES FOR ENERGY-SAVING LAMPS AND THEIR PRODUCTION

DESCRIPTION INTRODUCTION AND BACKGROUND

The invention relates to amalgam spheres for introducing mercury into modern energy-saving lamps.

Modern energy-saving lamps of the TFL (tube fluorescent lamp) or CFL type (compact fluorescent lamp) type belong to the group of low-pressure gas discharge lamps. They comprise a gas discharge bulb which is filled with a mixture of mercury vapour and argon and is coated on the inside with a fluorescent luminophore. The ultraviolet radiation emitted by the mercury during operation is converted by the luminophore coating into visible light by means of fluorescence. The lamps are therefore also referred to as fluorescent lamps.

The mercury required for operation of the lamps was in the past introduced as liquid metal into the gas discharge bulbs. However, introduction of the mercury in the form of amalgam spheres into the gas discharge bulbs has been known for a long time. This makes the handling of the toxic mercury easier and increases the accuracy of metering.

U.S. Pat. No. 4,145,634 describes the use of amalgam pellets which contain 36 atom % of indium and, owing to the high mercury content, contain a large proportion of liquid even at room temperature. The pellets therefore tend to conglutinate when they come into contact with one another. This can be prevented by coating the pellets with suitable materials in powder form. Stable metal oxides (titanium oxide, zirconium oxide, silicon dioxide, magnesium oxide and aluminium oxide), graphite, glass powder, phosphors, borax, antimony oxide and metal powders which do not form an amalgam with mercury (aluminium, iron and chromium) are proposed.

WO 94/18692 describes the use of pellets of zinc amalgam containing from 5 to 60% by weight, preferably from 40 to 60% by weight, of mercury. To produce spheroidal amalgam pellets, the process described in U.S. Pat. No. 4,216,178, in which the molten amalgam is broken up into small droplets by means of a vibrationally excited discharge nozzle and cooled in a cooling medium to below the solidification temperature, is employed.

The pellets are not coated as described in WO 94/18692.

To produce amalgam spheres from the melt, the amalgam has to be heated to a temperature at which the amalgam is completely molten. In the case of a zinc amalgam, this is ensured reliably only at a temperature above 420° C. These high processing temperatures result in a high vapour pressure of mercury and make appropriate safety precautions necessary because of the toxicity of mercury.

JP 2000251836 describes the use of amalgam pellets of tin amalgam for the production of fluorescent lamps. The tin amalgam preferably has only a low mercury content with a tin/mercury atom ratio of 90-80:10-20. This corresponds to a mercury content of from 15.8 to 29.7% by weight. JP 2000251836 gives no information as to how spherical pellets are produced from the amalgam.

A disadvantage of the tin amalgam described in JP 2000251836 is the low mercury content. This makes relatively large amalgam spheres necessary if a particular amount of mercury is to be introduced into the discharge lamps. Owing to the increasing miniaturization which is also being sought in the case of energy-saving lamps, this can lead to problems in the construction and manufacture of the lamps.

SUMMARY OF THE INVENTION

It is therefore an object of the invention to provide amalgam spheres of tin amalgam which have a high mercury content and can be reliably stored and used in the production of energy-saving lamps without endangering human health.

This object is achieved by amalgam spheres of a tin amalgam which has a mercury content in the range from 30 to 70% by weight. The amalgam spheres preferably have a mercury content of from 30 to 60% by weight and in particular from 40 to 55% by weight.

DETAILED DESCRIPTION OF THE INVENTION

The spheres can be produced from a melt of the amalgam by a process described in EP 1381485 B1. For this purpose, the completely molten amalgam is introduced dropwise into a cooling medium having a temperature below the solidification temperature of the amalgam. The temperature of the cooling medium is preferably from 10 to 20° C. below the liquidus temperature of the amalgam. It is advantageous here that tin amalgams melt completely at temperatures below 230° C. The outlay for ensuring occupational hygiene in the production of tin amalgam spheres is therefore considerably lower than in the case of zinc amalgam spheres.

As cooling medium, preference is given to using a mineral oil, an organic oil or a synthetic oil. A silicone oil has been found to be very useful. After formation of the amalgam spheres in the cooling medium, they are separated off from the cooling medium and degreased.

Amalgam spheres having diameters in the range from 50 to 2000 μm, preferably from 500 to 1500 μm, are suitable for the purposes of the invention.

It has been found that liquid phases occur on the surface of the amalgam spheres which have been produced in this way, and the spheres therefore conglutinate during storage and handling if no countermeasures are taken. Conglutination can be prevented by, for example, storing and processing the amalgam spheres at temperatures below 8° C. For storage, a temperature of −18° C. is preferred.

The tendency of the amalgam spheres to conglutinate can be largely suppressed by coating the degreased spheres with a metal or alloy powder which forms an amalgam with mercury. The amalgamation of the metal powder forms a surface layer having a low mercury content on the spheres and since this no longer contains any liquid phases at the usual processing temperatures of the amalgam spheres, it reduces the tendency for conglutination compared to the untreated spheres.

The metal or alloy powder used for the coating should not contain any particles having a particle diameter greater than 100 μm. Particles having larger particle diameters amalgamate only incompletely and lead to a rough surface of the spheres, which makes metering of the spheres more difficult. Preference is given to using a metal or alloy powder whose powder particles have a particle diameter of less than 80 μm. Particular preference is given to metal or alloy powders having an average particle diameter $d_{50}$ in the range from 5 to 15 μm. Suitable metals have been found to be tin and zinc and alloys of tin or of zinc. Tin or a tin alloy are preferred. Good results have been obtained using alloys of tin with silver and copper, in particular the alloy SnAg3Cu0.5.

To coat the amalgam spheres with the metal or alloy powder, the spheres can, for example, be placed in a rotating vessel and sprinkled with the metal or alloy powder while being continually mixed until conglutination of the spheres can no longer be observed. The amount of metal or alloy powder applied to the amalgam spheres is in the range from 1 to 10% by weight, preferably from 2 to 4% by weight, based on the weight of the amalgam spheres.

A further reduction in the tendency for conglutination is obtained when the amalgam spheres are additionally coated with a powder of a metal oxide in an amount of from 0.001 to 1% by weight, preferably from 0.01 to 0.5% by weight and in particular in an amount of 0.1% by weight, based on the weight of the amalgam spheres, after coating with the metal or alloy powder. The same procedure as for the application of the metal or alloy powder can be employed for this purpose. Suitable metal oxides for the coating are, for example, titanium oxide, zirconium oxide, silicon oxide and aluminium oxide. Preference is given to using an aluminium oxide prepared by flame pyrolysis and having an average particle size of less than 5 μm, preferably less than 1 μm.

The powder layers applied improve the handling of the amalgam spheres in automatic metering machines. The amalgam spheres can stay in such automatic metering machines for an average of up to 3 hours at room temperature before they are introduced into a fluorescent lamp. It has been found here that the amalgam spheres coated with metal or alloy powder and with metal oxide powder withstand the average residence time of 3 hours at temperatures of up to 40° C. in the automatic metering machine without problems. If only one of the two layers is applied, some detachment of the layers applied occurs before the average residence time of 3 hours has elapsed.

The invention is illustrated by the following table. The table shows calculated values for the total mass (Sn+Hg) and the mass of mercury (Hg) of tin amalgam spheres as a function of the diameter of the spheres and for tin amalgams having mercury contents of from 20 to 50% by weight. In addition, the table shows the densities p of the various amalgams as have been used for the calculations.

When spheres of the same diameter are employed, the use of tin amalgam having high mercury contents enables significantly more mercury to be introduced into the gas discharge bulbs than when a tin amalgam having a low mercury content of only 20% by weight is used. Thus, amalgam spheres of SnHg50 containing 50% by weight of mercury contain about three times the mass of mercury as amalgam spheres of SnHg20 containing only 20% by weight of mercury.

TABLE

Total mass and mass of mercury as a function of the sphere diameter for tin amalgam spheres having mercury contents in the range from 20 to 50% by weight

| | SnHg20 | | SnHg30 | | SnHg40 ρ = 8.96 g/cm³ | | SnHg50 ρ = 9.5 g/cm³ | |
|---|---|---|---|---|---|---|---|---|
| | ρ = 8.05 g/cm³ | | ρ = 8.48 g/cm³ | | Sn + | | Sn + | |
| Ø [mm] | Sn + Hg [mg] | Hg [mg] | Sn + Hg [mg] | Hg [mg] | Hg [mg] | Hg [mg] | Hg [mg] | Hg [mg] |
| 0.70 | 1.45 | 0.29 | 1.5 | 0.46 | 1.6 | 0.64 | 1.7 | 0.85 |
| 0.80 | 2.16 | 0.43 | 2.3 | 0.68 | 2.4 | 0.96 | 2.5 | 1.27 |
| 0.90 | 3.07 | 0.61 | 3.2 | 0.97 | 3.4 | 1.37 | 3.6 | 1.81 |
| 1.00 | 4.21 | 0.84 | 4.4 | 1.33 | 4.7 | 1.88 | 5.0 | 2.49 |
| 1.10 | 5.61 | 1.12 | 5.9 | 1.77 | 6.2 | 2.50 | 6.6 | 3.31 |
| 1.20 | 7.28 | 1.46 | 7.7 | 2.30 | 8.1 | 3.24 | 8.6 | 4.30 |
| 1.30 | 9.26 | 1.85 | 9.7 | 2.92 | 10.3 | 4.12 | 10.9 | 5.46 |
| 1.40 | 11.56 | 2.31 | 12.2 | 3.65 | 12.9 | 5.15 | 13.6 | 6.82 |
| 1.50 | 14.22 | 2.84 | 15.0 | 4.49 | 15.8 | 6.33 | 16.8 | 8.39 |

The invention claimed is:

1. A tin amalgam sphere comprising at least tin and mercury, wherein the tin amalgam sphere has a mercury content of 30% to 70% by weight and a tin to mercury atom ratio of about 80-42:20-58.

2. The amalgam sphere of claim 1, further comprising a coat which is formed by applying an amount of metal or alloy powder on the surface of the amalgam sphere.

3. The amalgam sphere of claim 1, wherein the amalgam sphere has a diameter in the range from 50 μm to 2000 μm.

4. The amalgam sphere of claim 2, wherein the metal or alloy powder has a particle diameter of less than 100 μm.

5. The amalgam sphere of claim 2, wherein the metal or alloy powder comprises tin; zinc; an alloy of tin or of zinc; or an alloy of tin with silver and copper.

6. The amalgam sphere of claim 2, wherein the amalgam sphere is additionally coated with a powder of a metal oxide.

7. A coated tin amalgam sphere comprising:

a tin amalgam sphere comprising at least tin and mercury, wherein the tin amalgam sphere has a mercury content of 30% to 70% by weight and a tin to mercury atom ratio of about 80-42:20-58; and a coat which is formed by applying an amount of metal or alloy powder on the surface of the tin amalgam sphere which forms an amalgam with mercury at the surface of the amalgam sphere.

8. The coated sphere according to claim 7, whereby the amalgam sphere is made by a process consisting of obtaining an alloy consisting essentially of tin and mercury, said alloy has a mercury content of 30 to 70% by weight, melting the alloy into a molten alloy, introducing a drop of the molten alloy having a diameter of 50 to 2000 μm into a cooling medium having a temperature below the solidification temperature of the alloy to form the sphere, separating the sphere from the cooling medium, and degreasing the sphere.

9. A coated sphere comprising:

a tin and mercury alloy in the shape of a sphere, said alloy having a mercury content of 30 to 70% by weight and a tin to mercury atom ratio of about 80-42:20-58; and a coat formed by applying tin, silver and copper in the form of a metal or alloy powder on the surface of the sphere to thereby amalgamate with mercury at the surface of the sphere.

10. The coated sphere of claim 9, wherein the coated sphere consists of the sphere, the coat, and an additional metal oxide coat.

11. A process for producing the tin amalgam sphere according to claim 2, comprising: melting the amalgam completely; introducing the melt dropwise into a cooling medium having a temperature below the solidification temperature of the amalgam; and subsequently separating off the tin amalgam sphere formed from the cooling medium.

12. The process according to claim 11, wherein a mineral oil, an organic oil, or a synthetic oil is used as cooling medium.

13. The process according to claim 12, wherein the amalgam spheres are degreased after having been separated off from the cooling medium and, at room temperature, and sprinkled with a metal or alloy powder while being continually mixed until conglutination of the spheres can no longer be observed to thereby form the coat.

14. The process according to claim 13, wherein the amalgam spheres are additionally coated with a powder of a metal oxide while being continually mixed in a further step.

15. A fluorescent lamp which comprises the amalgam sphere according to claim 1.

16. A fluorescent lamp which comprises the amalgam sphere according to claim 7.

17. A fluorescent lamp which comprises the amalgam sphere according to claim 9.

18. A tin amalgam sphere comprising at least tin and mercury, wherein the tin amalgam sphere has a mercury content of 30% to 70% by weight and the mass of mercury to the total mass of tin and mercury is about 0.3 to about 0.5 over a diameter ranging from 700 μm to 1500 μm of the amalgam sphere.

19. The amalgam sphere of claim 18, further comprising a coat which is formed by applying an amount of metal or alloy powder on the surface of the amalgam sphere.

20. The amalgam sphere of claim 19, wherein the metal or alloy powder has a particle diameter of less than 100 μm.

21. The amalgam sphere of claim 19, wherein the amalgam sphere is additionally coated with a powder of a metal oxide.

22. A fluorescent lamp which comprises the amalgam sphere according to claim 18.

23. A process for producing the tin amalgam sphere according to claim 19, comprising: melting the amalgam completely; introducing the melt dropwise into a cooling medium having a temperature below the solidification temperature of the amalgam; and subsequently separating off the tin amalgam sphere formed from the cooling medium, and wherein the amalgam spheres are degreased after having been separated of from the cooling medium and, at room temperature, and sprinkled with a metal or alloy powder comprising tin, zinc, an alloy of tin or of zinc, or an alloy of tin with silver and copper, while being continually mixed until conglutination of the spheres can no longer be observed to thereby form the coat and such that the coat forms an amalgam with mercury at the surface of the amalgam sphere.

24. The process according to claim 23, wherein the amalgam spheres are additionally coated with a powder of a metal oxide while being continually mixed in a further step.

* * * * *